US005818154A

United States Patent [19]

Helbig et al.

[11] Patent Number: 5,818,154

[45] Date of Patent: Oct. 6, 1998

[54] HALOGEN INCANDESCENT LAMP IN CEMENTLESS BASE

[75] Inventors: Peter Helbig, Sontheim; Hermann Steiner, Herbrechtingen; Gerhard Behr, Altheim; Ulrich Lindenmaier, Herbrechtingen, all of Germany

[73] Assignee: Patent-Treuhand-Gesellschaft für elektrische Glühlampen mbH, Munich, Germany

[21] Appl. No.: 781,287

[22] Filed: Jan. 13, 1997

Related U.S. Application Data

[63] Continuation of PCT/DE95/00983 Jul. 27, 1995.

[30] Foreign Application Priority Data

Aug. 10, 1994 [DE] Germany ..... 44 28 357.1
Jan. 16, 1996 [DE] Germany ..... 196 01 396.8

[51] Int. Cl.[6] ..... H01J 5/48

[52] U.S. Cl. ..... 313/318.01; 313/315; 313/317; 362/226

[58] Field of Search ..... 313/315, 317, 313/318.01, 318.02; 362/226; 439/611, 613, 617, 618, 220, 375

[56] References Cited

U.S. PATENT DOCUMENTS

| | | | |
|---|---|---|---|
| 3,631,379 | 12/1971 | Willoughby et al. . | |
| 3,898,506 | 8/1975 | Wright et al. . | |
| 4,492,893 | 1/1985 | Steiner et al. | 313/318 |
| 4,763,038 | 8/1988 | Takayama | 313/318 |
| 5,229,683 | 7/1993 | Eckhardt et al. | 313/318 |

FOREIGN PATENT DOCUMENTS

| | | |
|---|---|---|
| 0 070 548 A2 | 1/1983 | European Pat. Off. . |
| 1 908 641 | 9/1969 | Germany . |

*Primary Examiner*—Sandra L. O'Shea
*Assistant Examiner*—Matthew J. Gerike
*Attorney, Agent, or Firm*—Frishauf, Holtz, Goodman, Langer & Chick, P.C.

[57] ABSTRACT

The lamp according to the invention has a metal holder part 2 with a recess, in which the pinch seal 10 of the lamp bulb 1 is clampingly fixed with the aid of a plurality of support tabs 21*a*, 21*b*, 22*a*, 22*b*, 23*a*, 23*b*. In order to reduce the danger of damage to the pinch seal 10 when the lamp is being mounted on its base, the pinch seal 10 is tapered is graduated fashion toward the base, and all the support tabs 21*a*, 21*b*, 22*a*, 22*b*, 23*a*, 23*b* that act upon the pinch seal 10 are oriented toward the broad sides of the pinch seal 10, which is substantially rectangular in cross section, while the narrow sides of the pinch seal 10 are located in the holder part 2 without touching it. The narrow sides of the pinch seal (10) are retained in the holder (2) spaced from the holder. Guide ribs (50*a*, 50*b*) are formed on the pinch seal (10) positioned off-center, and laterally relatively staggered. Support tabs (21, 20*b*) fitting against the pinch seal in the region of the guide ribs, are formed with recesses (24*a*, 24*b*), which are wider than the width of the guide ribs, and also laterally staggered and offset so that the rib-and-recess combination provide for reliable lateral positioning of the lamp in the base, by laterally positioning the pinch seal in the base, and, further, ensuring that the seal cannot cant upon insertion of the lamp in the base. The ribs and recesses can be so arranged to form, respectively, right and left lateral abutment and support surfaces.

13 Claims, 5 Drawing Sheets

HALOGEN INCANDESCENT LAMP IN CEMENTLESS BASE

This application is a Continuation-in-Part of PCT Application DE 95/00983, Helbig et al., U.S. designated, filed Jul. 27, 1995, (claiming priority Germany, P 44 28 357.1, Aug. 10, 1994).

Reference to related patent, the disclosure of which is hereby incorporated by reference:
U.S. Pat. No. 4,492,893, Steiner et al.

FIELD OF THE INVENTION

The invention relates to a halogen incandescent lamp in a cementless base and particularly suitable for automotive headlamps.

BACKGROUND

A halogen incandescent lamp in a cementless base for use in a motor vehicle headlight, is described in U.S. Pat. No. 4,492,893, Steiner et al. This lamp has a lamp bulb with a pinch seal that has two broad sides and two narrow sides. It is clampingly fixed in a recess of a holder part that is part of the base. Securing the pinch end in the holder part is done by means of a plurality of securing or support tabs which act on both the broad sides and the narrow sides of the pinch seal. The thickness of the pinch seal is uniform over its entire length and the support tabs resting in clamping engagement against the broad sides of the pinch seal exert a strong pressure on the pinch seal. It has been found that this pressure can damage the glass at the pinch seal when the lamp is being mounted on its base. The supporting tabs acting on the narrow sides of the pinch seal may, because of the relatively small bearing surface and the strong contact pressure against the narrow sides, even cause splitting of the pinch seal.

THE INVENTION

It is an object of the invention to provide a halogen incandescent lamp in a cementless base with an improved base, in which, when the lamp is being mounted on its base, the risk of damage to the pinch seal is substantially reduced.

Briefly, the halogen incandescent lamp according to the invention is carried by a metal holder part, which is a component of the lamp base. The holder part has a stamped-out recess, in which the pinch seal, having two broad sides and two narrow sides, of the lamp bulb is inserted. In accordance with a feature of the invention, support tabs are formed onto the holder part, located to act upon the broad sides of the pinch seal, which is substantially rectangular in cross section, while the narrow sides of the pinch seal are located in the recess of the holder part without, however, touching it, that is, clear of the holder part. As a result, the tolerances in the width of the pinch seal do not affect the level of the supporting forces. In addition, the pinch seal of the lamp bulb is tapered in the direction of the base, such that the pinch seal on its free proximate end toward the base has a lesser thickness than on its end distal, or remote from the base.

As a result of this shape, and these provisions, the danger of damage to the pinch seal, e.g. on insertion into the holder part is reduced in comparison with the prior art.

Advantageously, and in accordance with a feature of the invention, the broad sides of the pinch seal are each provided with a guide rib extending longitudinally, parallel to the narrow sides. The guide ribs are adapted to fit, each, in a recess of the two support tabs resting clampingly on the broad sides. The width of the recesses in the support tabs is greater than the width of the ribs.

In accordance with another feature of the invention, the ribs and recesses are laterally offset, or staggered with respect to each other. Further, they are located off-center on opposite broad sides of the pinch seal, so that one guide rib and engaging recess in the associated tab, form a left side abutment and support for the pinch seal, while the other guide rib and engaging recess in the associated tab form the right side abutment and support. Thus, the ribs-and-recess combinations provide for reliable lateral positioning of the pinch seal in the base. The arrangement also ensures that the seal will not cant upon insertion of the lamp in the base, e.g. by automatic machinery.

Together with the guide ribs, the support tabs permit lateral positioning of the pinch seal in the holder part. The aforementioned support tabs are resilient. Their free ends, each together with two luglike protrusions projecting upward from the broad sides of the pinch seal, form a detent closure, which once the support tabs have locked in place behind the detent protrusions, prevents the pinch seal from being pulled out of the holder part. Advantageously, the holder part also has four additional support tabs, so that the two broad sides of the pinch seal and the support tabs each have four bearing or supporting points in common.

The lamp bulb, in the transitional region to the pinch seal, is also provided with a plurality of formed-on depth stops, which once the lamp has been assembled are seated on the holder part. These depth stops advantageously rest on four support tabs and exert a slight pressure on them. In cooperation with the aforementioned detent closure, they provide for an axially fixed position of the pinch seal in the holder part. The holder part according to the invention is advantageously of stainless steel, rather than German silver, i.e. argentan. Thus nickel-coating of the holder part, which is environmentally polluting, can be omitted.

DRAWINGS

The invention will be described in further detail below in terms of a preferred exemplary embodiment. Shown are:

FIG. 1, a schematic side view of a halogen incandescent lamp in a cementless base in accordance with the preferred exemplary embodiment;

FIG. 2, a view from below of the holder part of the preferred exemplary embodiment;

FIG. 3, a cross section through the pinch seal of the halogen incandescent lamp of the preferred exemplary embodiment, in which the sectional plane extends parallel to the narrow sides of the pinch seal;

FIG. 4, a cross section through the holder part of FIG. 2;

FIG. 5, a side view, partly in section, of the lamp bulb of the preferred exemplary embodiment; and FIG. 6, a schematic view from below the holder part and the pinch seal of the preferred exemplary embodiment.

DETAILED DESCRIPTION

Figure 1:
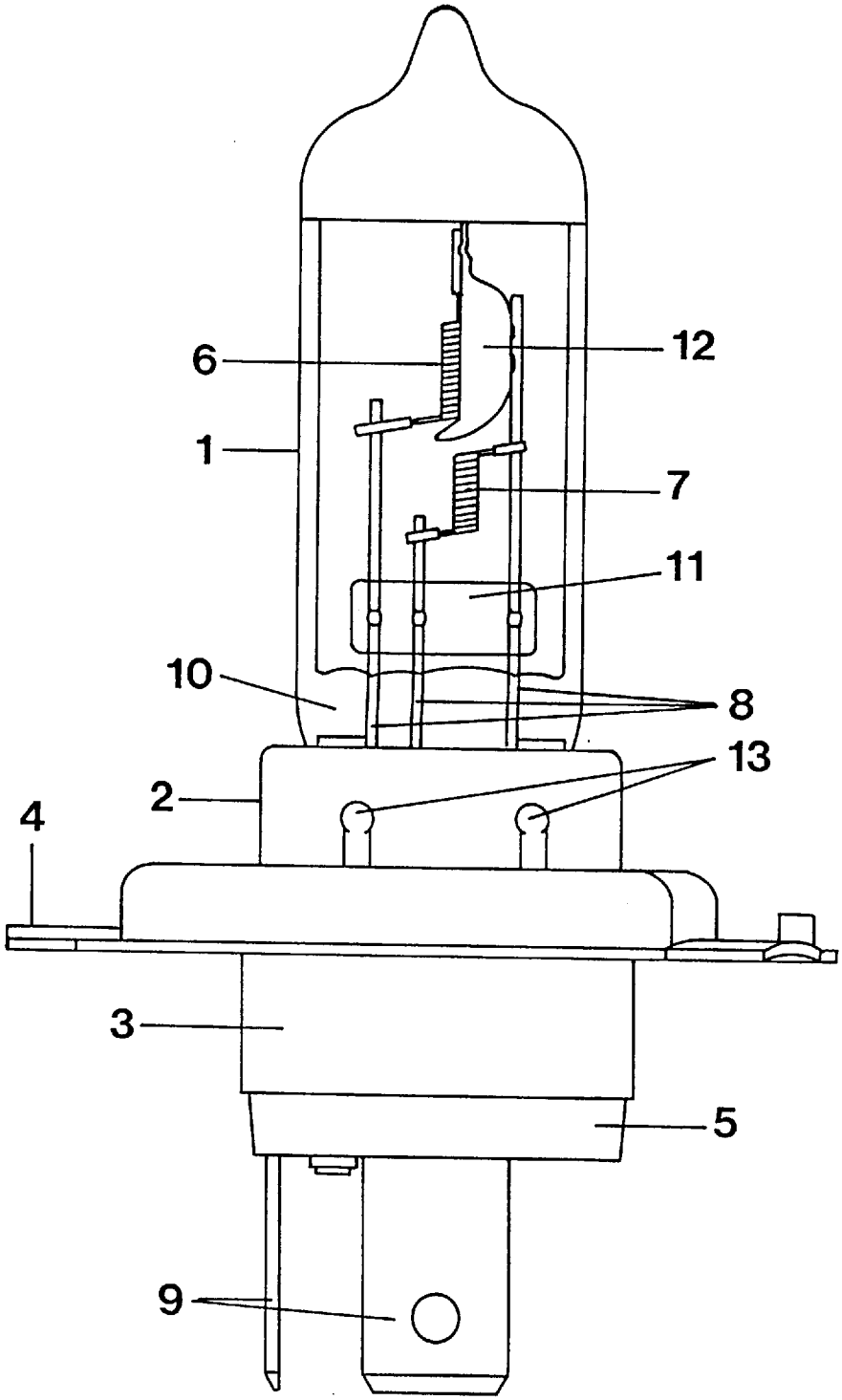

The halogen incandescent lamp in a cementless base of the invention is illustrated in a preferred exemplary embodiment as a halogen incandescent lamp for use in a motor vehicle headlight. FIG. 1 illustrates the basic structure of this lamp. The halogen incandescent lamp of the invention has a lamp bulb 1 of hard glass, pinched-sealed tightly on one end. The pinch seal 10 of the lamp bulb 1 is clampingly fixed in a cup-shaped holder part 2 of special steel. The lamp base is formed by a holder part 2, together with a base sleeve 3, an adjusting plate 4 formed onto it, and a base block 5. The holder part 2 is welded to the adjusting plate 4 via welding lugs 13 stamped out of the adjusting plate 4 and bent upwardly. Located inside the lamp bulb 1 are two filaments 6, 7 which are each electrically conductively connected to a respective contact lug 9 via three power leads 8 that protrude from the pinch seal 10 and are fused into a glass bead 11. One of the filaments 6 is provided with a dimmer hood 12.

Figure 2:
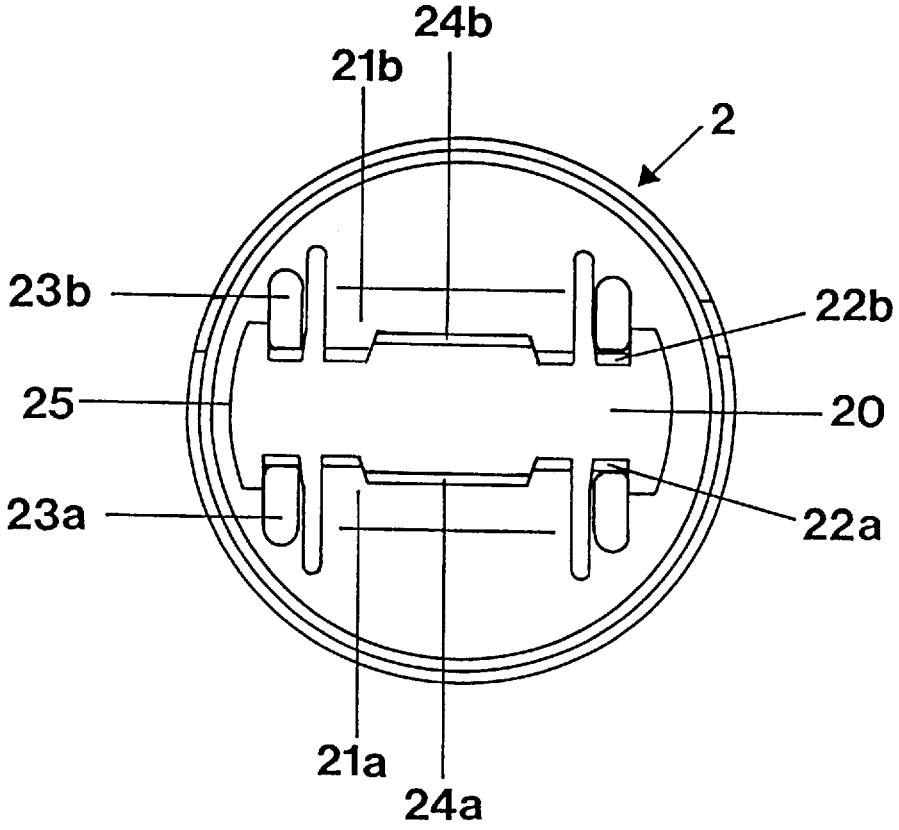
Figure 3:
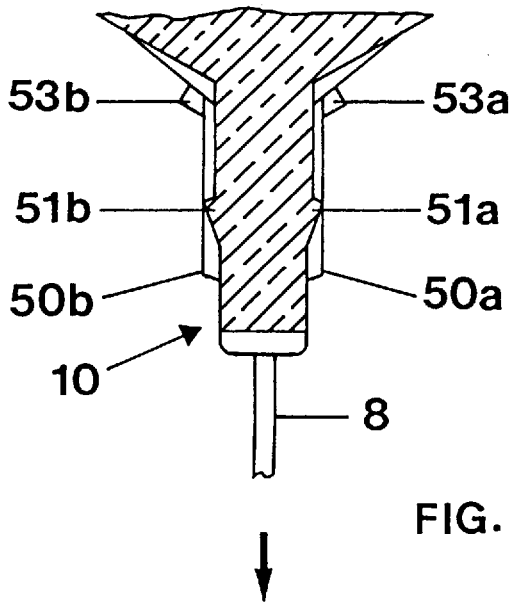
Figure 4:
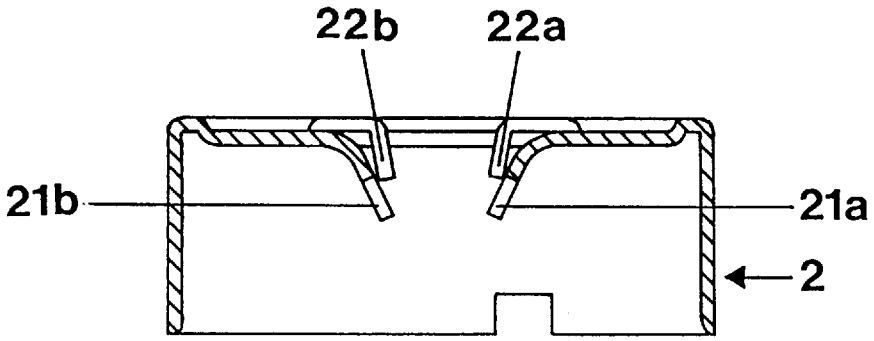
Figure 5:
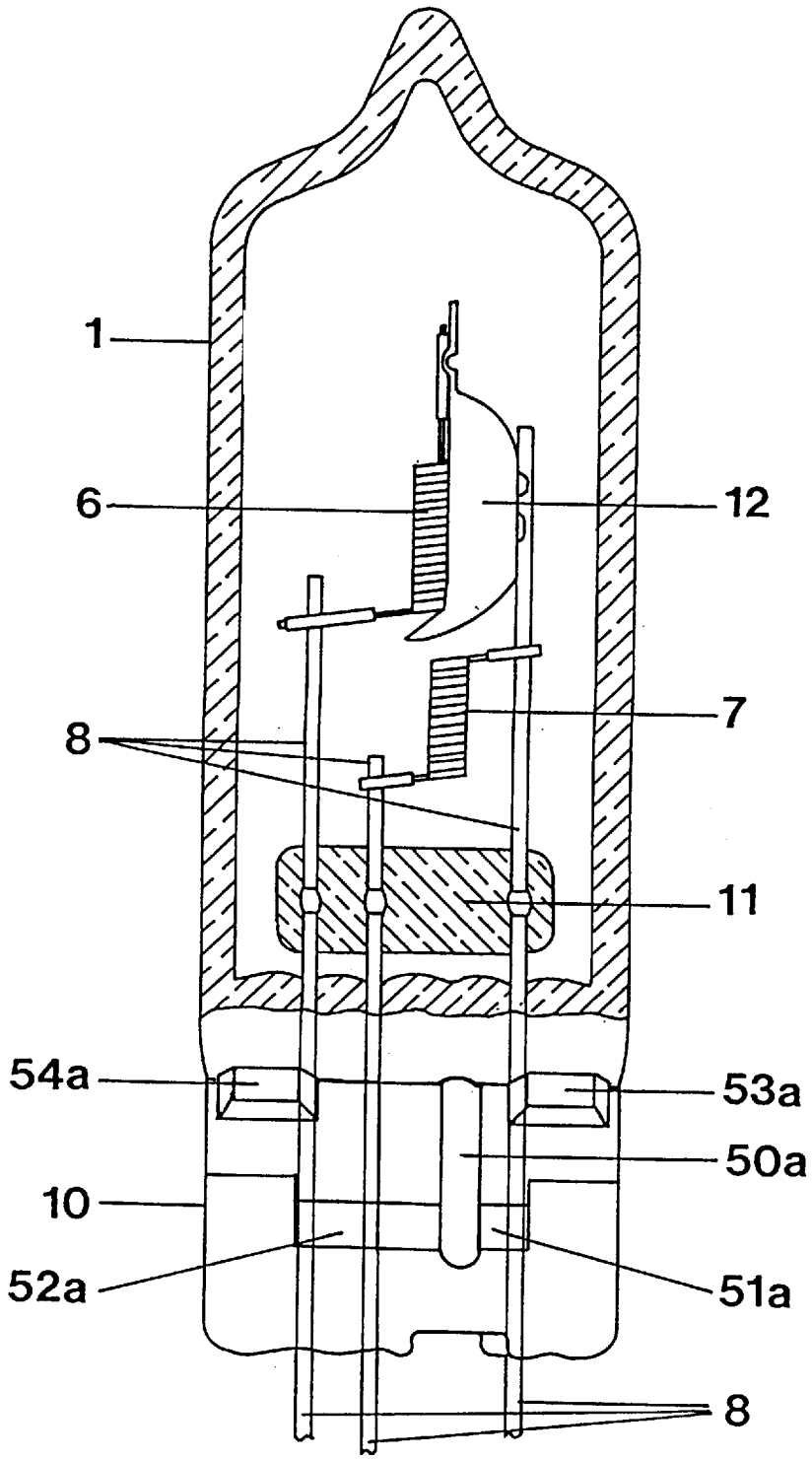
Figure 6:
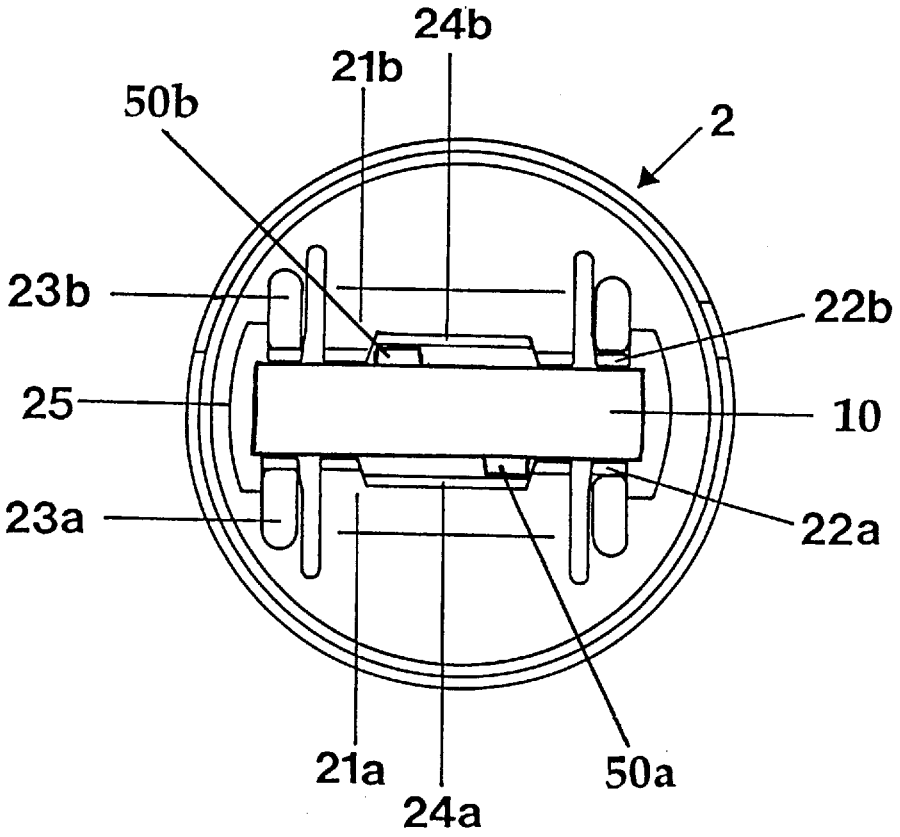

The parts of the lamp essential to understanding of the invention are shown in FIGS. 2–5. FIG. 2 shows the holder part of the halogen incandescent lamp according to the invention, seen from below. FIGS. 3 and 4 illustrate the cooperation of the pinch seal 10 and the holder part 2. The holder part 2 has a stamped-out recess 20, in which the pinch seal 10 is clampingly fixed.

Six support tabs 21*a*, 21*b*, 22*a*, 22*b*, 23*a*, 23*b* are formed on the holder part 2 and bent downward, that is, in the direction of the contact lugs 9; these support tabs rest clampingly against the broad sides of the pinch seal 10, which is essentially rectangular in cross section. Four of the support tabs 22*a*, 22*b*, 23*a*, 23*b* are reinforced by means of creases or beads, which in the horizontally extending portion lend them an approximately V-shaped cross section, while the two remaining support tabs 21*a*, 21*b* each have a recess 24*a*, 24*b*. The pinch seal 10 has two guide ribs 50*a*, 50*b* which are off-center, laterally staggered, or offset (see FIG. 5) with respect to each other, formed at opposite ends. The ribs 50*a*, 50*b* engage recesses 24*a*, 24*b*, each adapted with a loose fit, to receive a respective guide rib 50*a*, 50*b* with clearance. The guide ribs 50*a*, 50*b* extend in the longitudinal direction of the lamp bulb, that is, parallel to the narrow sides of the pinch seal 10. The width of the recesses 24*a*, 24*b* is wider than the width of the associated guide ribs 50*a*, 50*b*. The guide ribs 50*a*, 50*b* so engage the recesses 24*a*, 24*b* of the support tabs 21*a*, 21*b* that tab 21*a* and rib 50*a* form and define a right-side abutment and support for the pinch seal 10, while tab 21*b* and rib 50*b* form and define a left-side abutment and support.

Respective luglike protrusion 51*a*, 52*a*, 51*b*, 52*b* each, are likewise formed onto the pinch seal 10 on both sides of the guide ribs 50*a*, 50*b*. The upper end of these luglike protrusions 51*a*, 52*a*, 51*b*, 52*b*, together with the free ends of the support tabs 21*a*, 21*b*, forms a detent catch closure. The pinch seal 10 is tapered in steps toward the bottom, or in other words toward the base. The thickness of the pinch seal 10, below the luglike protrusions 51*a*, 52*a*, 51*b*, 52*b*, is approximately 3.4 mm, while above the luglike protrusions 51*a*, 52*a*, 51*b*, 52*b*, it is approximately 3.8 mm. The narrow sides of the pinch seal 10 are surrounded, but without touching, by circularly curved edges 25 of the recess 20 in the holder part 2.

The pinch seal 10 is also equipped with four depth stops 53*a*, 54*a*, 53*b*, 54*b*, which are formed onto the broad sides of the pinch seal 10 in the transitional region to the lamp bulb 1. These depth stops, after assembly, are seated on the support tabs 22*a*, 22*b*, 23*a*, 23*b*, which because of their creases or beads protrude from the surface of the cap of the holder part 2.

We claim:

1. A halogen incandescent lamp comprising the combination of a lamp bulb (1) having a pinch seal, wherein the pinch seal (10) has two broad sides and two narrow sides formed on, and closing said bulb; and a base, wherein the base has a base sleeve (3) and a metal holder part (2) secured to the base sleeve (3), the holder part (2) being formed with a recess (20) in which the pinch seal (10) is clampingly retained, and support tabs (21*a*, 21*b*, 22*a*, 22*b*, 23*a*, 23*b*), formed on the holder part (2), and clampingly engaged in the pinch seal (10); and wherein, in accordance with the invention, the pinch seal (10) of the bulb is tapered in the direction toward the base;

all the support tabs (21*a*, 21*b*, 22*a*, 22*b*, 23*a*, 23*b*) of the base are formed onto the holder part (2) are oriented toward the broad sides of the pinch seal (10) and located to engage and act on the broad sides of the pinch seal (10); and wherein the narrow sides of the pinch seal (10) are located in the recess (20) spaced from and clear of the holder part (2).

2. The lamp of claim 1, wherein the broad sides of the pinch seal (10) are each equipped with one formed-on guide rib (50*a*, 50*b*) extending parallel to the narrow sides; and two of the support tabs (21*a*, 21*b*), formed on the holder part (20), which each rest clampingly on one narrow side of the pinch seal (10), are provided with a recess (24*a*, 24*b*) adapted to fit over and receive the respective guide rib (50*a*, 50*b*).

3. The lamp of claim 1, wherein the broad sides of the pinch seal (10) are each equipped with luglike protrusions (51*a*, 51*b*, 52*a*, 52*b*), which together with the free ends of the support tabs (21*a*, 21*b*) form a detent catch closure.

4. The lamp of claim 1, wherein the broad sides of the pinch seal (10) are provided with formed-on depth stops (53*a*, 53*b*, 54*a*, 54*b*), which rest on the holder part (2).

5. The lamp of claim 1, wherein the holder part (2) has six support tabs (21*a*, 21*b*, 22*a*, 22*b*, 23*a*, 23*b*), which, with the two broad sides of the pinch seal (10) form at least four bearing points.

6. The lamp of claim 5, wherein the broad sides of the pinch seal (10) are provided with formed-on depth stops (53*a*, 53*b*, 54*a*, 54*b*), which rest on the holder part (2); and the depth stops (53*a*, 53*b*, 54*a*, 54*b*) are seated on said four support tabs (22*a*, 22*b*, 23*a*, 23*b*).

7. The lamp of claim 1, wherein the holder part (2) comprises stainless steel.

8. The lamp of claim 1, wherein the broad sides of the pinch seal (10) are each equipped with a formed-on guide rib (50*a*, 50*b*) located, respectively, at opposite sides of the pinch seal and extending parallel to the narrow sides of the pinch seal (10) and hence in longitudinal direction of the lamp bulb (1); and two of the support tabs (21*a*, 21*b*), oriented toward the broad sides of the pinch seal (10) and formed on the holder part, are provided with a recess (24*a*, 24*b*) adapted to fit over and receive the respective guide rib;

and wherein the two guide ribs (50*a*, 50*b*) are located off-center with respect to a central axis of the lamp bulb (1) and laterally respectively offset with respect to each other;

the recesses (24*a*, 24*b*), on the support tabs (21*a*, 21*b*) being wider than said guide ribs (50*a*, 50*b*) and clampingly engage the broader sides of the pinch seal; and a first one of said guide ribs (50*a*) is located with respect to a first recess (24*a*) in such position that, with the associated support tab (21*a*), it forms a lateral abutment, or support at one lateral side of the pinch seal (10), and the second guide rib (50*b*) is so positioned in the recess (24*b*) that, with the associated support tab (21*b*), it forms a lateral abutment or support at the other lateral side of the pinch seal (10).

9. A halogen incandescent lamp in a cementless base comprising the combination of a lamp bulb (1) having a pinch seal (10), wherein the pinch seal (10) has two broad sides and two narrow sides formed on and closing said bulb; and a base, wherein the base has a base sleeve (3) and a metal holder part (2) secured to the base sleeve (3), the holder part (2) being formed with a recess (20) in which the pinch seal (10) is clampingly retained, and support tabs (21*a,* 21*b;* 22*a,* 22*b;* 23*a,* 23*b*) formed on the holder part and clampingly engaging the pinch seal (10), wherein in accordance with the invention the support tabs (21*a,* 21*b;* 22*a,* 22*b;* 23*a,* 23*b*) formed on the holder part (2) and engaging the pinch seal (10) are oriented towards the broad sides of the pinch seal;

the narrow sides of the pinch seal (10) are located spaced from and clear of the holder part (2);

the broad sides of the pinch seal are each formed with a guide rib (50*a,* 50*b*) extending parallel to the narrow sides and located off-center with respect to a central axis of the lamp, staggered laterally with respect to each other; and wherein two oppositely positioned support tabs (21*a,* 21*b*), located to engage the pinch seal (10) in the region of said guide ribs (50*a,* 50*b*) on the pinch seal, are each formed with recesses (24*a,* 24*b*) wider than said guide ribs (50*a,* 50*b*) to receive said guide ribs (50*a,* 50*b*) on the pinch seal, with clearance.

10. The lamp of claim 9, wherein one edge of one of the recesses (24*a*) engages a lateral edge of one (50*a*) of said ribs, and an edge of the respective recess (24*b*) in an opposite support tab (21*b*) engages a laterally opposite edge of the guide rib (50*b*) received in the respective recess.

11. The lamp of claim 9, wherein said recesses (24*a,* 24*b*) extend across the base for a distance to span the offset with respect to the central axis of the lamp of the guide ribs (50*a,* 50*b*).

12. The lamp of claim 1, wherein the broad sides of the pinch seal are each formed with a guide rib (50*a,* 50*b*) extending parallel to the narrow sides and located off-center with respect to a central axis of the lamp, staggered laterally with respect to each other; and wherein two oppositely positioned support tabs (21*a,* 21*b*), located to engage the pinch seal (10) in the region of said guide ribs (50*a,* 50*b*) on the pinch seal, are each formed with recesses (24*a,* 24*b*) wider than said guide ribs (50*a,* 50*b*) to receive said guide ribs (50*a,* 50*b*) on the pinch seal, with clearance.

13. The lamp of claim 12, wherein said recesses (24*a,* 24*b*) extend across the base for a distance to span the offset with respect to the central axis of the lamp of the guide ribs (50*a,* 50*b*).

* * * * *